US005796681A

United States Patent [19]

Aronzo

[11] Patent Number: 5,796,681

[45] Date of Patent: Aug. 18, 1998

[54] TIME SCHEDULER PARTICULARLY USEFUL IN TESTS

[76] Inventor: Ehud Aronzo, 3/71 Yigal Alon Street, Kiryat Motzkin, Israel

[21] Appl. No.: 889,890

[22] Filed: Jul. 8, 1997

[51] Int. Cl.[6] ..... G04B 47/00; G04F 7/00

[52] U.S. Cl. ..... 368/10; 368/107

[58] Field of Search ..... 368/3, 10, 89, 368/107–113, 250, 251; 377/20

[56] References Cited

U.S. PATENT DOCUMENTS 5,140,564 8/1992 Rich ..... 368/107
5,642,334 6/1997 Liberman ..... 368/10

*Primary Examiner*—Vit W. Miska
*Attorney, Agent, or Firm*—Mark M. Friedman

[57] ABSTRACT

A time scheduler, particularly useful in tests, which includes a timing mechanism for measuring an overall time in the test and a counting mechanism for counting the number of question left unanswered as well as a confirmation key to be depressed by the user every time a question is completed. The scheduler also includes at least one visual display to indicate to the user various statistical parameters. The scheduler can also include a start button for initiating the timing mechanism and a question time display for registering the time available for a single question. Preferably, the device also includes at least one selector key for selecting the options preferred by the user prior to confirming the selection with the confirmation key and an alphanumeric display for displaying the user-selectable options to be selected with the selector key. In a preferred embodiment of the present invention, a question speed indicator indicates either whether the user is answering the questions at a faster rate than the average time available per question or the progress of the user relative to the number of questions remaining. At least one function key is provided to store parameters of a specific test type, such that the user can enter information for the test in advance and recall the information during the test.

17 Claims, 8 Drawing Sheets

TIME SCHEDULER PARTICULARLY USEFUL IN TESTS

FIELD AND BACKGROUND OF THE INVENTION

The present invention relates to a time scheduler and, in particular, it concerns a time scheduler particularly useful in tests.

It is known that individuals taking tests often do not have a satisfactory time allocation strategy and tend to waste exorbitant amounts of time on a single or a few questions leaving a substantial number of unanswered questions needing to be addressed in ever shorter periods of time. Needless to say this is not conducive to satisfactory test results and does not do justice to the individuals' knowledge. One attempt to address the problem has been to bring a stop watch to the test and time the overall time for the test and thereby try to meet a certain time frame. The use of a stop watch in tests is only a marginal improvement over using a regular watch. Alternatively, countdown timers have been used to try to remedy the problem, but like stopwatches they can only give an indication of the overall time for the test or the time remaining and do not provide any indication of the progress of the individual taking the test. Moreover, stopwatches and timers cannot indicate the number of questions completed or the number of questions which are yet unanswered once the individual answers a question out of sequence.

There is therefore a need for time scheduler that enables an individual taking a test to keep track of the overall time left in the test as well as the number of question already answered or remaining unanswered. Preferably, the time scheduler also indicates the rate at which the individual is answering each question. More preferably, the time scheduler also indicates whether the individual is answering the questions faster or slower than the overall time for the test divided by the overall number questions and multiplied by the number of questions answered.

SUMMARY OF THE INVENTION

According to the teachings of the present invention there is provided, a time scheduler particularly useful for a user answering an overall number of questions in an overall time available in a test including: a timing mechanism for measuring an overall time elapsed; a counting mechanism for counting a number of units; a front surface; a first display situated on the surface, for displaying a parameter selected from the group consisting of the overall time elapsed and the number of units; and a confirmation key on the surface, for changing the number of units, such that depressing the confirmation key changes the number of units by a single unit.

Preferably, the device according to the present invention further includes a second display on the surface, for displaying the time available for a single question.

Optionally, the device according to the present invention further includes a question speed indicator on the surface.

According to certain embodiments exemplified herein, the scheduler optionally includes at least one selector key on the surface, for selecting options preferred by the user.

Preferably, the time scheduler includes an alphanumeric display on the surface, for displaying the options.

More preferably, the first display and alphanumeric display are selected from the group consisting of LCD's, LED displays, dot matrix displays, passive displays, active displays and CRT displays.

According to further embodiments of the present invention, the scheduler includes at least one function key on the surface, for storing and recalling the parameters used in a previous test.

Optionally, the front surface is distributed between two parts of the scheduler connected by a hinge for readily folding the scheduler and facilitating economizing on the overall space the scheduler takes up.

According to still further embodiments of the present invention, the scheduler further includes a plurality of numeric keys on the surface, for entering the parameters of time and number of questions.

Preferably, the first display is a screen display and the screen display includes an indicator, for indicating when the time available in the test is substantially all but exhausted.

More preferably, the screen display is a display selected from the group consisting of LCD's, LED displays, dot matrix displays, passive displays, active displays and CRT displays.

Additionally, the device according to the present invention further includes a question time display on the surface, operated by the confirmation key, for timing a single question.

According to the most preferred embodiment exemplified herein, the time scheduler includes: a timing mechanism for measuring an overall time elapsed; a counting mechanism for counting a number of units; a front surface; a first display, situated on the surface, for displaying a parameter selected from the group consisting of the overall time elapsed and the number of units; a confirmation key on the surface, for changing the number of units, such that depressing the confirmation key changes the number of units by a single unit; a start button on the surface, for initiating the timing mechanism; a second display on the surface, for registering the time available for a single question; at least one selector key on the surface, for selecting the options preferred by the user prior to confirming the selection with the confirmation key; and an alphanumeric display on the surface, for displaying the user-selectable options to be selected with the selector key.

According to further embodiments exemplified herein, the device of the present invention includes: a question speed indicator on the surface; at least one function key on the surface, for storing parameters of a specific test type, such that the user does not need to reenter information for the test and can do so in advance and recall the information with the function key; a plurality of numeric keys on the surface, for inputting the overall number of questions in the test, the overall time for the test and other parameters deemed necessary by the user to be inputted prior to starting the test; and at least one function key on the surface, for storing and recalling the parameters used in a previous test.

Preferably, the surface is connected to an indicator, for indicating when the time available in the test is substantially all but exhausted.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a time scheduler particularly useful in tests.

The principles and operation of a time scheduler according to the present invention may be better understood with reference to the drawings and the accompanying description.

Figure 1:
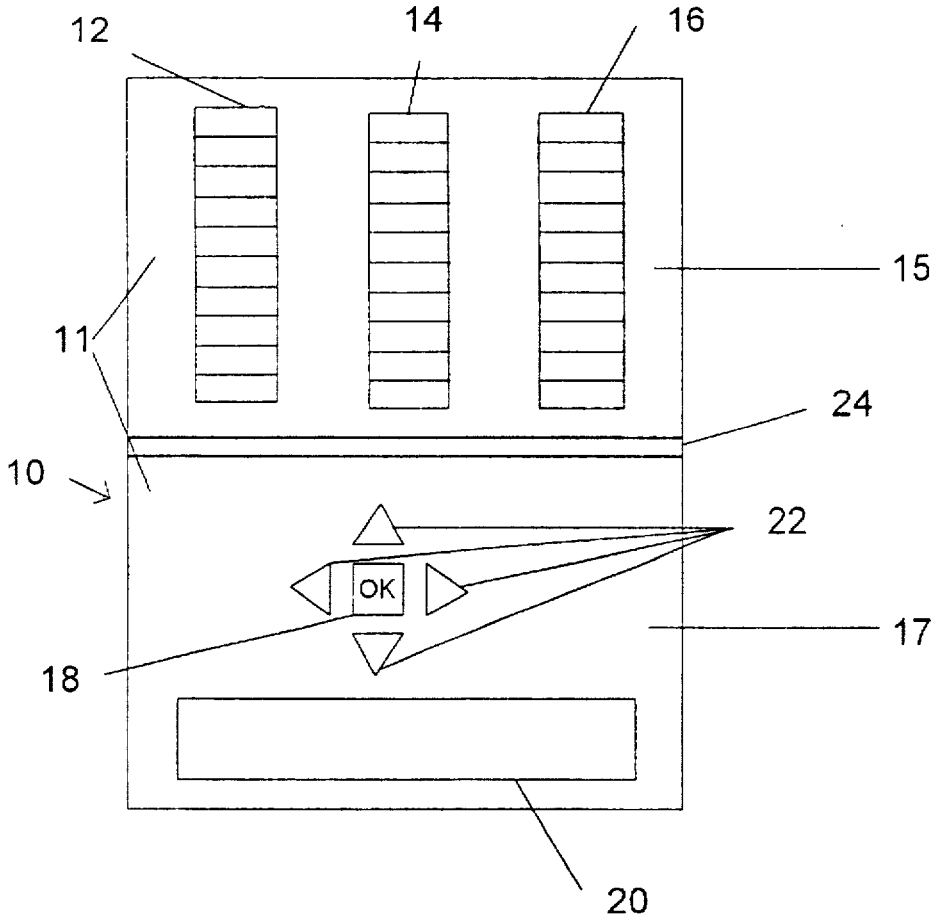
FIG. 1 is a top view of a first preferred embodiment of a folding time scheduler in an unfolded position.
Figure 2:
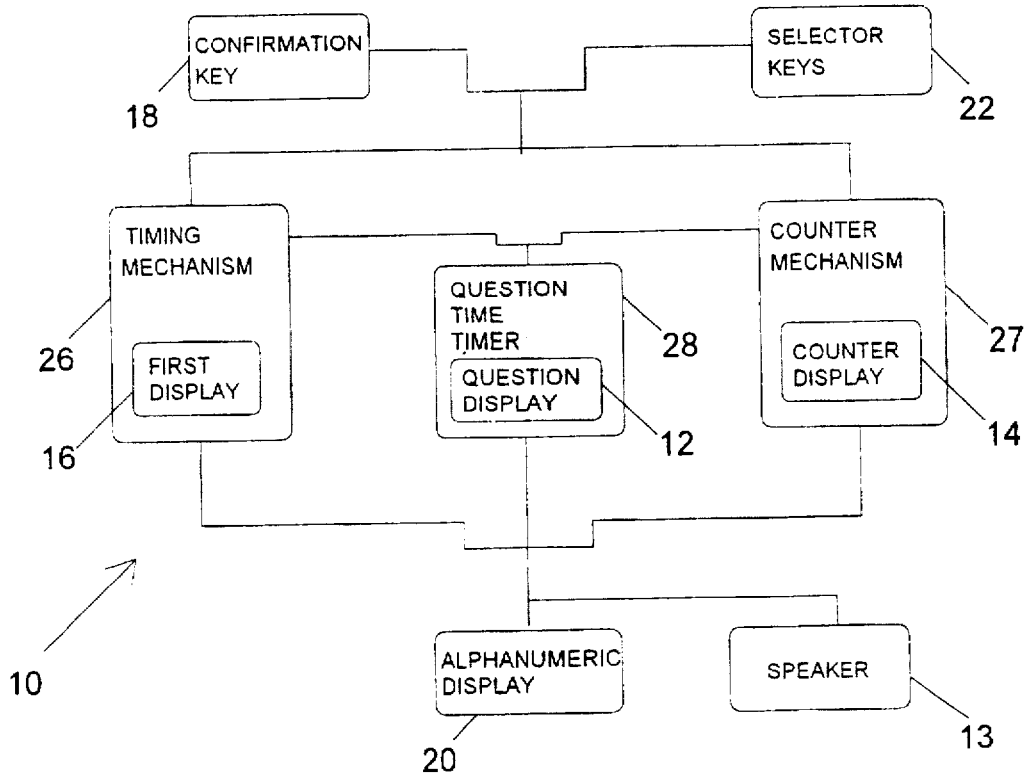
FIG. 2 is a block diagram of the first preferred embodiment of the device of the present invention.

Referring now to the drawings, FIGS. 1 and 2 show a first preferred embodiment of the device according to the present invention. With appropriate changes, the block diagram shown in FIG. 2 fits the embodiments shown in FIGS. 3, 7 and 8. As shown in FIGS. 1 and 2, a time scheduler 10 has a front surface 11. Surface 11 includes four selector keys 22 for selecting user preferred options and modes of operation as well as a confirmation key 18 for confirming the selection selected by depressing selector keys 22. Surface 11 further includes an alphanumeric display 20 for displaying the options and selections made and/or to be made by the user. Alphanumeric display 20 is preferably an LCD of a similar type to those found on organizers known in the art. Front surface 11 is preferably distributed between two parts 15 and 17 of scheduler 10 that are connected by a hinge 24, thereby rendering scheduler 10 foldable via hinge 24, thereby economizing on the overall space scheduler 10 takes up. Surface 11 also includes three visual displays designated 12, 14 and 16 to indicate to the user various statistical parameters.

First display 16 is part of a timing mechanism 26, and first display 16 displays the overall time remaining in the test. Timing mechanism 26 is either digital or analog and timing mechanism 26 measures an overall time elapsed in units of seconds or minutes. Preferably, first display 16 is in the form of a count-down timer. More preferably, first display 16 can use either an LCD bar display or a plurality of LED's, such that when the user starts the test all of the LED's are displayed and as the time remaining decreases the LED's go out to indicate the time remaining. Preferably, first display 16 indicates to the user when the time remaining is substantially all but exhausted. One of the ways first display 16 can display a shortage of time is by flashing or changing color. Scheduler 10 optionally includes a speaker 13, for emitting an audible sign indicating to the user when the time remaining is substantially all but exhausted.

Counter mechanism display 14 is part of a counter mechanism 27 that keeps track of the number of questions completed in the test. Preferably, counter mechanism 27 counts a number of units in single unit increments. Counter mechanism display 14 can also be in the form of a count-down counter showing the number of questions remaining. Alternatively, counter mechanism display 14 displays the number of questions answered. Additionally and preferably, counter mechanism display 14 uses either an LCD bar display or a plurality of LED's, such that when the user starts the test all of the LED's are displayed and, as the question remaining decrease, the LED's go out, such that the LED's displayed indicate the number of unanswered questions remaining in the test.

Question time display 12 keeps track of the time remaining to answer the current question in the test. Similarly to displays 14 and 16, question time display 12 is in the form of a count-down timer 28 showing the time remaining to answer the current question. Preferably, count-down timer 28 measures time in increments of a second or a minute. The time per question is calculated by dividing the overall time for the test by the overall number of questions in the test. Alternatively, question time display 12 displays the average time remaining for each question. The time per question is calculated by dividing the overall time remaining in the test by the overall number of remaining questions in the test. Additionally and preferably, question time display 12 uses either an LCD bar display or a plurality of LED's, such that when the user starts the question all of the LED's are displayed and as the time remaining to answer the question decreases, the LED's go out, such that the LED's displayed indicate the time remaining to answer the question.

Figure 3:
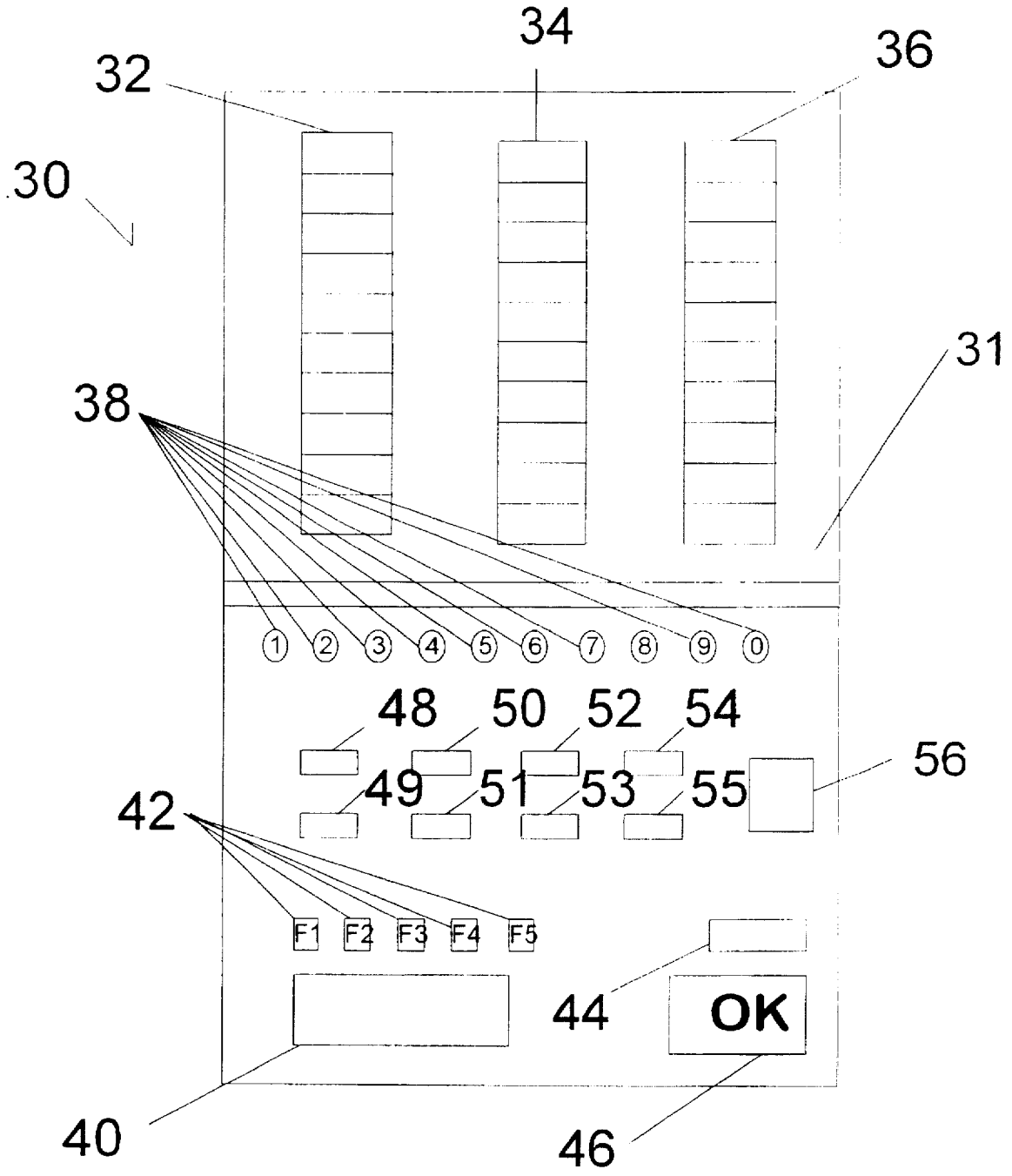
FIG. 3 is a top view of a second preferred embodiment of the device according to the present invention.

A second preferred embodiment of the device according to the present invention is shown in FIG. 3. Similarly to FIG. 1, FIG. 3 shows a time scheduler 30, having a front surface 31, and including a confirmation key 46 for confirming the selection selected by the user, as well as an alphanumeric display 40 for displaying the options and selections made and/or to be made by the user. Alphanumeric display 40 is preferably an LCD of a similar type to those found on organizers known in the art. Surface 31 also includes three visual displays designated 32, 34 and 36 similar to displays 12, 14 and 16 of FIG. 1 for indicating to the user various statistical parameters.

Similarly to the device of FIG. 1, display 36 is part of a timing mechanism, akin to timing mechanism 26 of FIG. 1, and displays the overall time remaining in the test. Preferably, timing mechanism display 36 is in the form of a count-down timer. More preferably, timing mechanism display 36 uses either an LCD bar display or a plurality of LED's, such that when the user starts the test, all of the LED's are displayed and, as the time remaining decreases, the LED's go out to indicate the time remaining. Preferably, timing mechanism display 36 indicates to the user when the time remaining is substantially all but exhausted. One of the ways timing mechanism display 36 can display a shortage of time is by flashing or changing color. According to certain embodiments exemplified herein, scheduler 30 optionally includes a speaker (not shown), similar to speaker 13 of FIG. 2, for emitting an audible sign indicating to the user when the time remaining is substantially all but exhausted.

Like display 14 of FIG. 1, display 34 is part of a counter mechanism, and keeps track of the number of questions completed in the test. Counter mechanism display 34 can also display the count in the form of a count-down counter showing the number of questions remaining. Alternatively, counter mechanism display 34 displays the number of questions answered. Additionally and preferably, counter mechanism display 34 uses either an LCD bar display or a plurality of LED's, such that when the user starts the test, all of the LED's are displayed and, as the questions remaining decrease, the LED's go out, such that the LED's displayed indicate the unanswered questions remaining in the test.

Here as well, question time display 32, configured in the same manner as question time display 12 of FIG. 1, keeps track of the time remaining to answer the current question in the test. Similarly to displays 34 and 36, question time display 32 is in the form of a count-down timer showing the time remaining to answer the question. The time per question is calculated by dividing the overall time for the test by the overall number of questions in the test. Alternatively, question time display 32 displays the average time remaining for each question. The average time per question is calculated by dividing the time remaining in the test by the number of questions remaining in the test. Additionally and preferably, question time display 32 uses either an LCD bar display or a plurality of LED's, such that when the user starts the question, all of the LED's are displayed and, as the time remaining to answer the question decreases, the LED's go out, such that the LED's displayed indicate the time remaining to answer the question.

Surface 31 also includes a plurality of numeric keys 38 to input the overall number of questions in the test, the overall time for the test and other parameters to be inputted prior to starting the test. Surface 31 also includes a plurality of keys designated 48–55, each having a specific use as explained hereinbelow. A time key 48 is provided for selecting the time available in the test and/or the time available for a specific section of the test having different time settings than other sections of the test. Depressing time key 48 and depressing numeric keys 38 inputs the time settings for that specific test or section in the test. A subsequent depressing of confirmation key 46 confirms the options selected. In case the user enters an erroneous entry, scheduler 30 also includes a delete key 49 facilitating the ready correction of such an erroneous entry by depressing delete key 49 as many times as needed to remove the error and reentering the correct information without having to input a new set of information in its entirety. Scheduler 30 optionally includes an amount key 50 for inputting the overall number of questions in the section or the test as well as an average key 51 for calculating the average time used to answer each question. The user may depress average key 51 either during or after the test or section has been completed, thereby receiving an output of the average time spent on answering each question. Preferably, the readout is displayed on alphanumeric display 40 in a digital form. For the convenience of the user, an end key 52 is provided which, when depressed by the user, indicates the end of the string of entries, and also indicates that the user has completed the test, notwithstanding the fact that there still are questions remaining unanswered as shown by counter mechanism display 34. When the user wishes to skip an option irrelevant to the test, he can elect to depress a next key 53 transferring the input to the next option while leaving the current option unchanged. As scheduler 30 has several modes of operation where, by way of example only, one or two of the four displays shown are of use to the user, a mode key 54 is provided for selecting which mode the user wishes to use.

Upon completing the entry of the parameters of the test, the user depresses a start button 44, situated on surface 31, initiating timing mechanism 32. The user then proceeds to complete the test. Upon answering a question, the user depresses confirmation key 46 to confirm that a question has just been completed, thereby removing a question from the number of questions remaining on counter mechanism display 34 which keeps track of the number of questions completed in the test. Alternatively, the depression of confirmation key 46, to confirm that a question has just been completed, also manifests itself by altering question time display 32, such that question time display 32 displays the average time remaining for each question. As explained hereinabove, the average time per question is calculated by dividing the time remaining in the test by the overall number of questions remaining in the test.

Upon completing the test, the user may want to store his performances for statistical and/or other purposes. In order to facilitate the ready storage of previous test information, the device includes a memory key 55. The depression of memory key 55 stores all of the parameters and relevant information of the last test taken. More preferably, the device according to the present invention facilitates the storage of a plurality of previous tests by depressing memory key 55 and numeric keys 38, thereby storing the information for later retrieval. Additionally, the user can use average key 51 for calculating the averages of the information of any number of previous tests. Alphanumeric display 40 optionally displays the progress of the use in a graphical display depicting the time taken to answer each question. The device of the present invention optionally also includes a "text" button 56 for effective negotiation of questions containing large amounts of text, such that when the user encounters of questions containing large amounts of text, depressing the text button allocates a predetermined amount of time for reading the text prior to initiating question time display 32. Alternatively, depressing the text button initiates the timer displayed on question time display 32, such that question time display 32 first allocates a predetermined amount of time for reading the text and then resets, allocating a second predetermined amount of time for answering the question by the user.

To further satisfy the user's needs, five function keys 42 are provided on surface 31, which can be used to store parameters of a specific type of section and/or test, such that the user does not need to enter or reenter information immediately prior to or during the test and can do so in advance and later recall the information by depressing function key 42 relevant to that section and/or test. Preferably, the user enters the overall time available in the test and/or section with time key 48 provided for selecting the time available in the test and/or the time available for a specific section of the test having different time settings than other sections of the test as well as amount key 50 provided for inputting the overall number of questions in the test. The subsequent depressing of function key 42 together with depressing memory key 55, stores all of the parameters and relevant information of the last test taken, thereby storing the parameters of the specific type of section and/or test, such that the user does not need to reenter information immediately prior to or during the test. When the user takes the test, he can readily recall the parameters by pressing the relevant function key 42 for that specific test or section.

Figure 4:
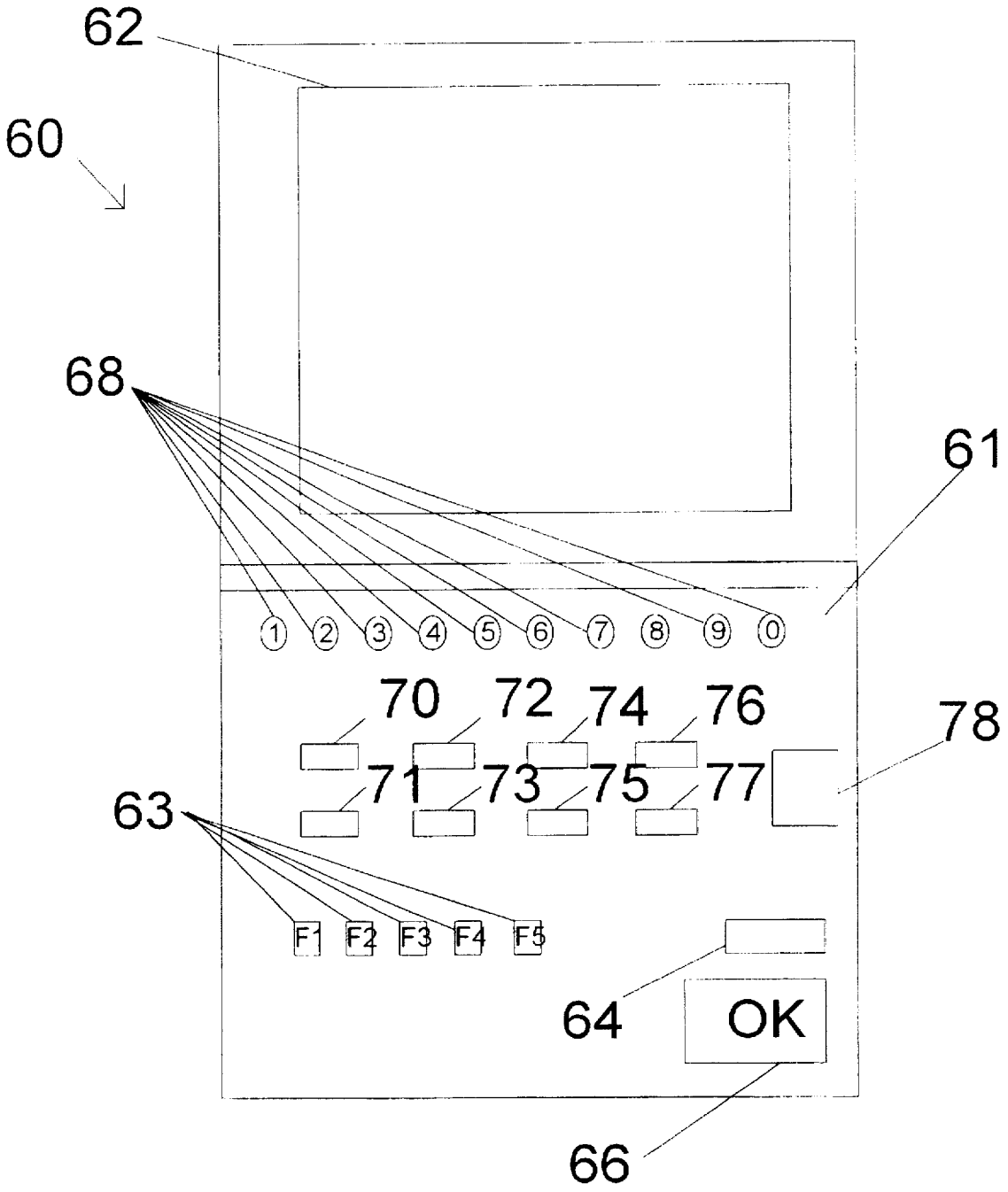
FIG. 4 is a top view of a third preferred embodiment of the device having a single screen display unit.

A third embodiment of the present invention is shown in FIG. 4. Similar to the device of FIG. 3, a time scheduler 60, having a front surface 61, includes a confirmation key 66 for confirming the selections selected by the user. Surface 61 also includes a plurality of keys designated 70–77, each having a specific use as explained hereinbelow. Sharing the same characteristics as time key 48 of FIG. 3, a time key 70 is provided for selecting the time available in the test and/or the time available for a specific section of the test having different time settings than other sections of the test. Depressing time key 70 and depressing an appropriate sequence of at least one of a plurality of numeric keys 68 (ten are shown), which numeric keys 68 are equivalent to numeric keys 38 of FIG. 3, inputs the time settings for that specific test or section in the test. Optionally, numeric keys 68 are used for inputting the overall number of questions in test, the overall time for the test and other parameters deemed necessary by the user to be inputted prior to starting the test. A subsequent depressing of confirmation key 66 confirms the options selected.

In case the user enters an erroneous entry, scheduler 60 also includes a delete key 71, akin to delete key 49 of FIG. 3. Delete key 71 facilitates the ready correction of such an erroneous entry by the user depressing delete key 71 as many times as needed to remove the error and reentering the correct information without having to reenter all of the information in its entirety. Scheduler 60 also optionally includes an amount key 72 for inputting the overall number of questions in the section or the test as well as an average key 73 for calculating the average time used to answer each question. Amount key 72 and average key 73 share the same characteristics as amount key 50 and average key 51 of FIG. 3, respectively. The user can elect to depress average key 73 either during or after the test or section has been completed, thereby receiving an output of the average time spent on answering each question. Preferably, the output is displayed on a screen display 62 in digital form. Screen display 62 is for displaying the options and selections made and/or to be made by the user. Screen display 62 is preferably either an LCD, LED display, dot matrix display, passive display, active display or a CRT display similar to but not limited to those found on portable computers known in the art. According to the device of the present invention, screen display 62 displays the time remaining in the test. Preferably, the time remaining in the test is displayed in the form of a count-down timer. More preferably, screen display 62 uses a bar display, such that when the user starts the test, all of the bars are displayed and as the time remaining decreases the bars are erased to indicate the time remaining. Also preferably, screen display 62 indicates to the user when the time remaining is substantially all but exhausted. One of the ways screen display 62 can display a shortage of time is by flashing or changing color. According to certain embodiments exemplified herein, screen display 62 is optionally connected to a speaker (not shown) similar to speaker 13 of FIG. 2, for emitting an audible sign indicating to the user when the time remaining is substantially all but exhausted. According to further embodiments exemplified herein, screen display 62 optionally displays the progress of the user in a graphical display depicting the time taken to answer each question. The device of the present invention optionally also includes a "text" button 78 for effective negotiation of questions containing large amounts of text, such that when the user encounters questions containing large amounts of text, depressing the text button allocates a predetermined amount of time for reading the text prior to initiating the timer. Alternatively, depressing the text button initiates the timer displayed on screen display 62, such that the timer, displayed on screen display 62, first allocates a predetermined amount of time for reading the text and then resets, allocating a second predetermined amount of time for answering the question by the user.

Screen display 62 also keeps track of the number of questions completed in the test. Screen display 62 displays the questions remaining in the form of a count-down counter showing the number of questions remaining to be answered. Alternatively, screen display 62 displays the number of questions already answered. Additionally and preferably, screen display 62 uses a bar display, such that when the user starts the test all of the bars are displayed and as the question remaining decrease the bars are erased, such that the remaining bars indicate the time remaining in the test. Alternatively, screen display 62 uses a digital display for indicating the time remaining in the test.

Here as well, screen display 62 can display the time remaining to answer the current question in the test. Similarly, screen display 62 preferably displays the time remaining to answer the current question in the form of a count-down timer showing the time remaining to answer the question. The time per question is calculated by dividing the overall time for the test by the overall number of questions in the test. Alternatively, screen display 62 displays the average time remaining for each question. The average time per question is calculated by dividing the time remaining in the test by the number of questions remaining in the test. Additionally and preferably, screen display 62 uses a bar display to display the time per question, such that when the user starts the question, all of the bars are displayed and, as the time remaining to answer the question decreases, the bars are erased, such that the remaining bars indicate the time remaining to answer the question test. Alternatively, screen display 62 uses a digital display for indicating the time remaining in the test.

For the convenience of the user, and similarly to end key 52 of FIG. 3, an end key 74 is provided which, when depressed by the user, indicates the end of the string of entries. Preferably, depressing end key 74 indicates the user has completed the test, notwithstanding the fact that there may still be questions remaining unanswered. When the user wishes to skip an option irrelevant to the test, he can elect to depress a next key 75, similar to next key 53 of FIG. 3, transferring the input to the next option while leaving the current option unchanged. As scheduler 60 has several modes of operation where, by way of example only, one or two of the three displays shown in FIGS. 1 and 3 are of use to the user, a mode key 76 is also provided which is similar to key 54 of FIG. 3, for selecting which mode the user wishes to use.

Like above, in the embodiment of FIG. 3, when the entering of the parameters of the test is completed, the user depresses a start button 64, on surface 61, initiating the timing mechanism, and the user then proceeds to complete the test. Upon answering a question, the user depresses confirmation key 66 to confirm that a question has just been completed, thereby removing a question from the number of questions remaining in the test as displayed on screen display 62 which keeps track of the number of questions completed in the test. Alternatively, the depression of confirmation key 66 to confirm that a question has just been completed, also manifests itself by altering the time remaining to answer the nest question as displayed on screen display 62, such that the question time displayed on screen display 62 is calculated by dividing the time remaining in the test by the number of questions remaining in the test.

Here as well, upon completing the test, the user may want to store his performances for statistical and/or other purposes. In order to facilitate the ready storage of previous test information, the device preferably includes a memory key 77, similar to memory key 55. The depression of memory key 77 stores all of the parameters and relevant information of the last test taken. More preferably, the device according to the present invention facilitates the storage of a plurality of timing performances in a series of tests by depressing both memory key 77 and numeric keys 68, thereby storing the information for later retrieval. The user can use average key 73 for calculating the averages of the information relating to any number of previous tests.

Similarly to the embodiment shown in FIG. 3, and to further satisfy the user's needs, five function keys 63 are provided which can be used to store the parameters of a specific type of section and/or test, such that the user does not need to reenter information immediately prior to or during the test and can do so in advance and later recall the information by depressing key 63 relevant to that section and/or test. Preferably, function keys 63 function substantially equivalently to function keys 42 of FIG. 3.

Figure 5:
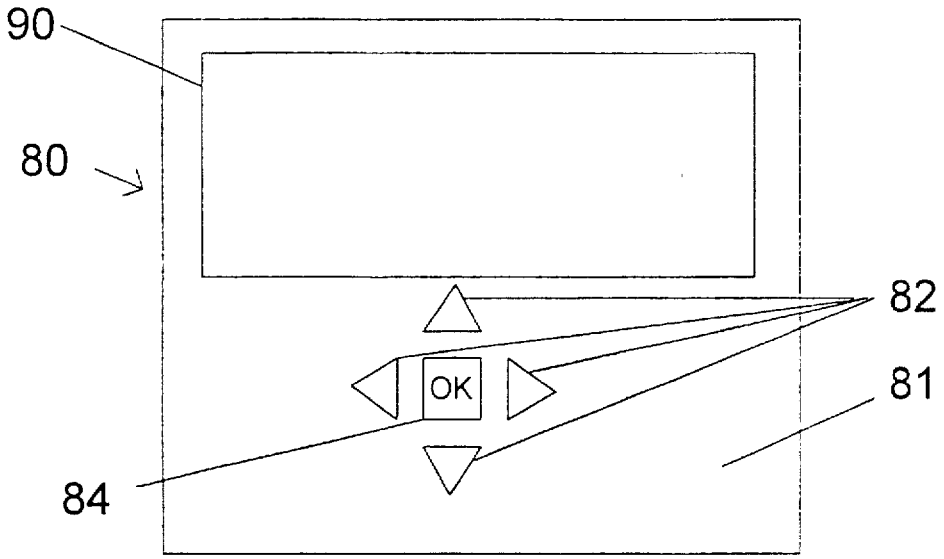
FIG. 5 is a frontal view of a fourth preferred embodiment of the present invention.

A fourth embodiment of the present invention is shown in FIG. 5. The device according to the fourth embodiment is particularly useful for pocket carry and minimal taking up of space. Similar to the device of FIG. 1, FIG. 5 shows a time scheduler 80, having a front surface 81, and includes four of selector keys 82 for selecting user preferred options and modes of operation is provided. Surface 81 also includes a confirmation key 84 for confirming the selection selected by depressing selector keys 82. The user can in a similar manner to the embodiment of FIG. 1 described hereinabove, utilize selector keys 82 for selecting the time available in the test and/or the time available for a specific section of the test having different time settings than other sections of the test. Selector keys 82 can also be utilized for inputting the time settings for that specific test or section in the test. A subsequent depressing of confirmation key 84 confirms the options selected.

In case the user enters an erroneous entry, selector keys 82 facilitate the ready correction of such an erroneous entry by the user depressing the left most selector key 82 as many times as needed to backtrack to the erroneous entry as well as the upper or lower selector key 82, thereby amending the error and reentering the correct information without having to reenter all of the information in its entirety. Alternatively, selector keys 82 can be used for inputting the overall number of questions in the section or the test as well as for selecting an "average" option for calculating the average time used to answer each question. The user can select the average option with selector keys 82 either during or after the test or section has been completed, thereby receiving an output of the average time spent on answering each question. Preferably, the output is displayed in digital form on a screen display 90, situated on surface 81. More preferably, screen display 90 has substantially the same configuration as screen display 62 of FIG. 4, inasmuch as screen display 90 is for displaying the options and selections made and/or to be made by the user. Similarly to screen display 62 of FIG. 4, screen display 90 is preferably either an LCD, LED display, dot matrix display, passive display, active display or a CRT display similar to but not limited to those found on portable computers known in the art. According to the device of the present invention, screen display 90 displays the time remaining in the test and preferably, the time remaining in the test is displayed in the form of a count-down timer. More preferably, screen display 90 uses a bar display, such that when the user starts the test, all of the bars are displayed and, as the time remaining decreases, the bars are erased indicating the time remaining. In addition, screen display 90 preferably also indicates to the user when the time remaining is substantially all but exhausted. One of the ways screen display 90 can display a shortage of time is by flashing or changing color. Scheduler 80 also optionally includes a speaker (not shown), similar to speaker 13 of FIG. 2, for emitting an audible sign indicating to the user when the time remaining is substantially all but exhausted.

As explained above, and akin to screen display 62 of FIG. 4, screen display 90 also keeps track of the number of questions completed in the test. Similarly, screen display 90 displays the number of questions remaining in the form of a count-down counter. Alternatively, screen display 90 displays the number of questions answered. Additionally and preferably, screen display 90 uses a bar display, such that when the user starts the test, all of the bars are displayed and, as the question remaining decrease, the bars are erased, such that the remaining bars indicate the number of questions remaining in the test. Alternatively, screen display 90 uses a digital display for indicating the number of questions remaining in the test.

Here as well, screen display 90 displays the time remaining to answer the current question in the test. Similarly, screen display 90 displays the time remaining to answer the current question in the form of a count-down timer showing the time remaining to answer the question. The time per question is calculated by dividing the overall time for the test by the overall number of questions in the test. Alternatively, screen display 90 displays the average time remaining for each question. The average time per question is calculated by dividing the time remaining in the test by the number of questions remaining in the test. Additionally and preferably, screen display 90 uses a bar display, such that when the user starts the question all of the bars are displayed and, as the time remaining to answer the question decreases, the bars are erased, such that the remaining bars indicate the time remaining to answer the question test. Alternatively, screen display 90 uses a digital display for indicating the time remaining in the test.

Selector keys 82 can also be used for inputting the overall number of questions in the test, the overall time for the test and other parameters deemed necessary by the user to be inputted prior to starting the test.

For the convenience of the user, selector keys 82 can be used for indicating the end of the string of entries, and also indicates the user has completed the test, notwithstanding the fact that there may still be questions remaining unanswered. When the user wishes to skip an option irrelevant to the test before him, he selects the next option with selector keys 82 transferring the input to the next option while leaving the current option unchanged. As scheduler 80 has several modes of operation where, by way of example only, one or two of the three parameters described hereinabove is of use to the user, a "mode" option can be selected with selector keys 82 selecting which mode the user wishes to use.

Upon completing the entry of the parameters of the test, the user depresses confirmation key 84, initiating the timing mechanism. The user then proceeds to complete the test. Upon answering a question, the user depresses confirmation key 84, confirming a question has just been completed, thereby removing a question from the number of questions remaining as displayed on screen display 90, and thereby keeping track of the number of questions completed in the test. Alternatively, the depression of confirmation key 84, confirming a question has just been completed, also manifests itself by altering the time remaining to answer the remainder of the questions displayed on screen display 90. Alternatively, screen display 90 displays the average time remaining for each question. As explained hereinabove, the average time per question is calculated by dividing the time remaining in the test by the number of questions remaining in the test.

Here as well, upon completing the test, the user may want to store his performances for statistical and/or other purposes. For facilitating the ready storage of previous test information, the device preferably includes a "memory" option selectable by selector keys 82. The selection of the memory option with selector keys 82 stores all of the parameters and relevant information of the last test taken. More preferably, the device according to the present invention facilitates the storage of a plurality of previous tests by selecting a numbered memory option with selector keys 82 and confirming the selection with confirmation key 84, thereby storing the information for later retrieval. The user can use the average option referred above to calculate the averages of the information of any number of previous tests.

In order to further satisfy the user's needs, the user can use selector keys 82 for selecting the function options to store parameters of a specific type of section and/or test, such that the user does not need to reenter information immediately prior to or during the test and can do so in advance and later recall the information with selector keys 82 and confirm the selection with confirmation key 84.

Figure 6:
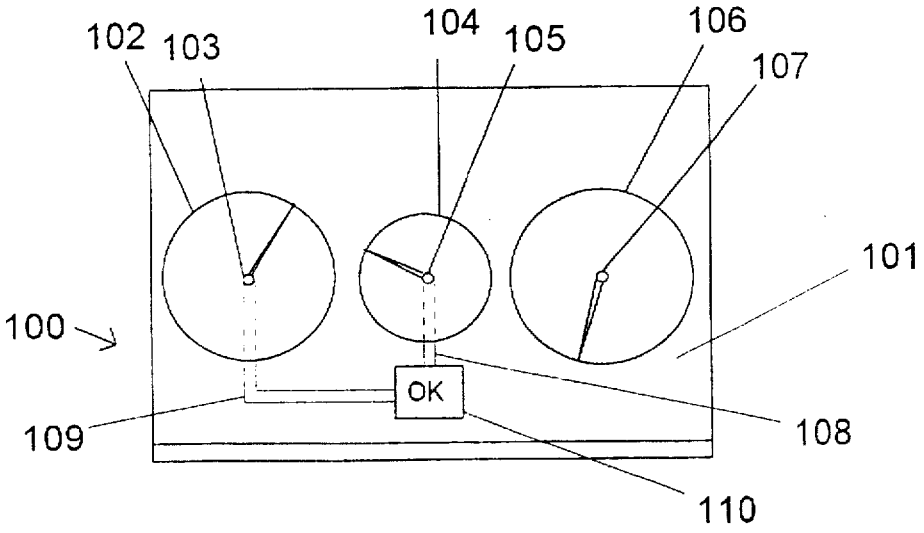
FIG. 6 is a top view of a fifth, analog preferred embodiment of the device of the present invention.

A fifth preferred embodiment of the device according to the present invention is shown in FIG. 6. This embodiment is particularly useful inasmuch as it is completely mechanical and can alternatively use, in addition to or instead of electric power, a simple or windup mechanism similar to those found in watches and clocks not requiring any batteries or electricity for power. FIG. 6 shows an analog time scheduler 100, having a front surface 101. Front surface 101 includes a confirmation key 110 for confirming the selection selected by the user, as well as three analog displays designated 102, 104 and 106 for indicating to the user various statistical parameters.

According to the device of the present invention, a display 106, situated on surface 101 is part of an analog timing mechanism, and displays the time remaining in the test. Preferably, timing mechanism display 106 is in the form of a count-down timer. More preferably, timing mechanism display 106 uses a time dial 107, such that when the user starts the test, time dial 107 is set by the user to the overall amount of time in the test and as the time remaining decreases time dial 107 is displaced indicating the time remaining. Alternatively, timing mechanism display 106 can be similar to count down timers found on appliances such as toaster-ovens known in the art. Preferably, time dial 107 completes a full circle every five hours thereby facilitating the ready recognition of time remaining as an arc of the circle. More preferably, the time is fully depleted when time dial 107 points substantially perpendicular to the length of scheduler 100.

Surface 101 also includes a counter 104 for keeping track and displaying of the number of questions completed in the test. Similarly to timing mechanism display 106, counter 104 is in the form of a count-down counter showing the number of questions remaining. Alternatively, counter 104 displays the number of questions answered. Preferably, counter 104 uses a counter dial 105, such that when the user starts the test, counter dial 105 is set by the user to the overall number of questions in the test and as the questions remaining to be answered decreases, counter dial 105 is displaced indicating the questions remaining. More preferably counter dial 105 completes a full circle every one hundred questions thereby facilitating the ready recognition of the questions remaining as an arc of the circle. Counter dial 105 advances one question every time confirmation key 110 is depressed by the user after completing a question in the test. More preferably, once the questions have all been answered, counter dial 105 points substantially perpendicular to the length of scheduler 100.

Likewise, surface 101 has a question timer display 102 for keeping track and displaying the time remaining to answer the current question in the test. Optionally, question time display 102 is in the form of a count-down timer showing the time remaining to answer the question. The time per question is calculated by the user by dividing the overall time for the test by the overall number of questions in the test and setting question time display 102 accordingly. Additionally and preferably, question time display 102 uses a question time dial 103, such that when the user starts the question, question time dial 103 is set by the user to the overall amount of time for the question and as the time remaining decreases, question time dial 103 is displaced, indicating the time remaining. Preferably, question time dial 103 completes a full circle every twenty minutes thereby facilitating the ready recognition of time remaining as an arc of the circle. More preferably, question time dial 103 resets every time confirmation key 110 is depressed by the user after completing a question in the test. Additionally and preferably, the time to answer a given question is fully depleted when question time dial 103 points substantially perpendicular to the length of scheduler 100.

In order to input the overall number of questions in the test, the user rotates counter dial 105 to the extent that counter dial 105 indicates the overall number of questions in the test. Similarly, in order to input the overall time for the test, the user rotates time dial 107 to the extent that time dial 107 indicates the overall time for the test. Likewise, in order to input the time available to answer each question in the test, the user rotates question time dial 103 to the extent that question time dial 103 now indicates the time available to answer each question in the test.

Depressing confirmation key 110 once confirms a question has been completed and rotates counter dial 105 via a rotator 108 to a sufficient degree, indicating there is one question less remaining in the test. Preferably, depressing confirmation key 110 once, confirms a question has been completed. More preferably, confirmation key 110, when depressed once, both rotates counter dial 105 via rotator 108 to a sufficient degree, indicating there is one question less remaining in the test and resets question time dial 103 via a resetter 109 to the position question time dial 103 was in after the user set the time for each question to be answered, and then initiates the timer.

Upon completing entry of the parameters of the test, the user depresses confirmation key 110 initiating the timer and the user then proceeds to complete the test. Upon answering a question, the user depresses confirmation key 110 to confirm that a question has just been completed, thereby removing a question from the number of questions remaining.

Figure 7:
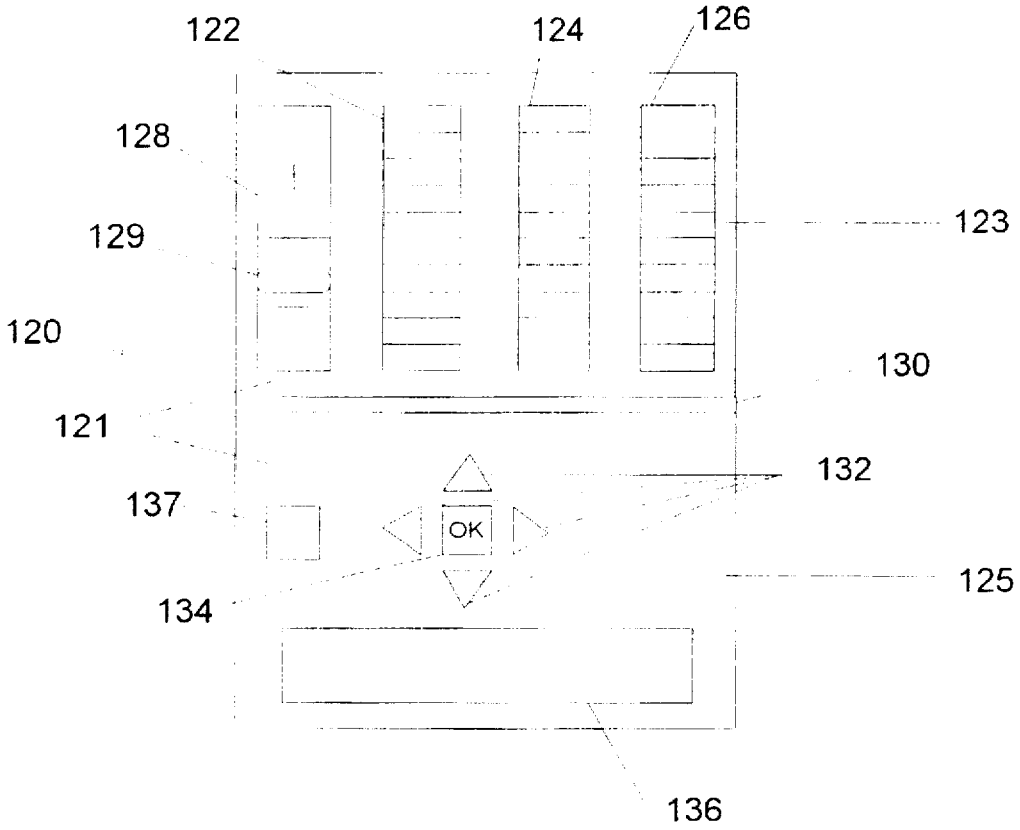
FIG. 7 is a top view of a sixth preferred embodiment of the device of the present invention similar to the embodiment of FIG. 1 and having an additional time indicator.

FIG. 7 shows a sixth preferred embodiment of the device according to the present invention. Similar to the first embodiment, a time scheduler 120, having a front surface 121, includes four selector keys 132. Like selector keys 22 of FIG. 1, selector keys 132 are for selecting user preferred options and modes of operation. Surface 121 also includes a confirmation key 134 of a similar configuration to confirmation key 18 of FIG. 1. Confirmation key 134 is for confirming the selection selected by depressing keys 132. Surface 121 further includes an alphanumeric display 136 for displaying the options and selections made and/or to be made by the user. Functionally similar to alphanumeric display 20 of FIG. 1, alphanumeric display 136 is preferably an LCD of a similar type to those found on organizers known in the art. Front surface 121 is preferably distributed between two parts 123 and 125 of scheduler 120 connected by a hinge 130, thereby rendering scheduler 120 foldable via hinge 130, in substantially the same way as hinge 24 in FIG. 1, thereby economizing on the overall space scheduler 120 takes up. Scheduler 120 also includes four visual displays for indicating to the user various statistical parameters.

A display 126, on surface 121, is part of a timing mechanism, and displays the overall time remaining in the test. Preferably, timing mechanism display 126 is in the form of a count-down timer. More preferably, timing mechanism display 126 can use either an LCD bar display or a plurality of LED's, such that when the user starts the test all of the LED's are displayed and as the time remaining decreases the LED's are erased indicating the time remaining. Preferably, timing mechanism display 126 indicates to the user when the time remaining is substantially all but exhausted. One of the ways timing mechanism display 126 can display a shortage of time is by flashing or changing color. Preferably, timing mechanism display 126 is connected to a speaker (not shown) similar to speaker 13 of FIG. 2, for emitting an audible sign indicating to the user when the time remaining is substantially all but exhausted.

Surface 121 also includes a display 124. Display 124 is part of a counter mechanism, and keeps track of the number of questions completed in the test. Counter mechanism display 124 can also be in the form of a count-down counter showing the number of questions remaining. Alternatively, counter mechanism display 124 displays the number of questions answered. Additionally and preferably, counter mechanism display 124 uses either an LCD bar display or a plurality of LED's, such that when the user starts the test all of the LED's are displayed and, as the question remaining decrease, the LED's go out, such that the LED's displayed indicate the unanswered questions remaining in the test.

Surface 121 includes a question time display 122 for keeping track of the time remaining to answer the current question in the test. Similarly to displays 124 and 126, question time display 122 is in the form of a count-down timer showing the time remaining to answer the question. The time per question is calculated by dividing the overall time for the test by the overall number of questions in the test. Alternatively, question time display 122 displays the average time remaining for each question. The average time per question is calculated by dividing the time remaining in test by the number of questions remaining in the test. Additionally and preferably, question time display 122 uses either an LCD bar display or a plurality of LED's, such that when the user starts the question all of the LED's are displayed and as the time remaining to answer the question decreases, the LED's go out, such that the LED's displayed indicate the time remaining to answer the question.

Furthermore, surface 121 also preferably includes a question speed indicator 128 for indicating whether the user is answering the questions at a slower or faster rate than the overall time for the test divided by the overall number of questions. Preferably, question speed indicator 128 can also indicate the progress of the user compared to the overall time in the test divided by the overall number of questions in the test and multiplied by the number of questions answered. Question speed indicator 128 uses a bar 129 for showing whether the user is answering the questions at a slower or faster rate than the overall time for the test divided by the overall number of questions. The higher bar 129 appears on question speed indicator 128, the faster the user is answering the questions in relation to the overall time for the test divided by the overall number of questions. The lower bar 129 appears on question speed indicator 128, the slower the user is answering the questions in relation to the overall time for the test divided by the overall number of questions. Thus, the user can get an immediate feedback on his progress at a glance without having to resort to any calculations. In a similar manner to the device shown in FIG. 1, alphanumeric display 136 preferably displays the progress of the user in a graphical display depicting the time taken to answer each question. The device of the present invention optionally also includes a "text" button 137 for effective negotiation of questions containing large amounts of text, such that when the user encounters questions containing large amounts of text, depressing the text button allocates a predetermined amount of time for reading the text, prior to initiating question time display 122. Alternatively, depressing the text button initiates the timer displayed on question time display 122, such that question time display 122 first allocates a predetermined amount of time for reading the text and then resets, allocating a second predetermined amount of time for answering the question by the user.

Figure 8:
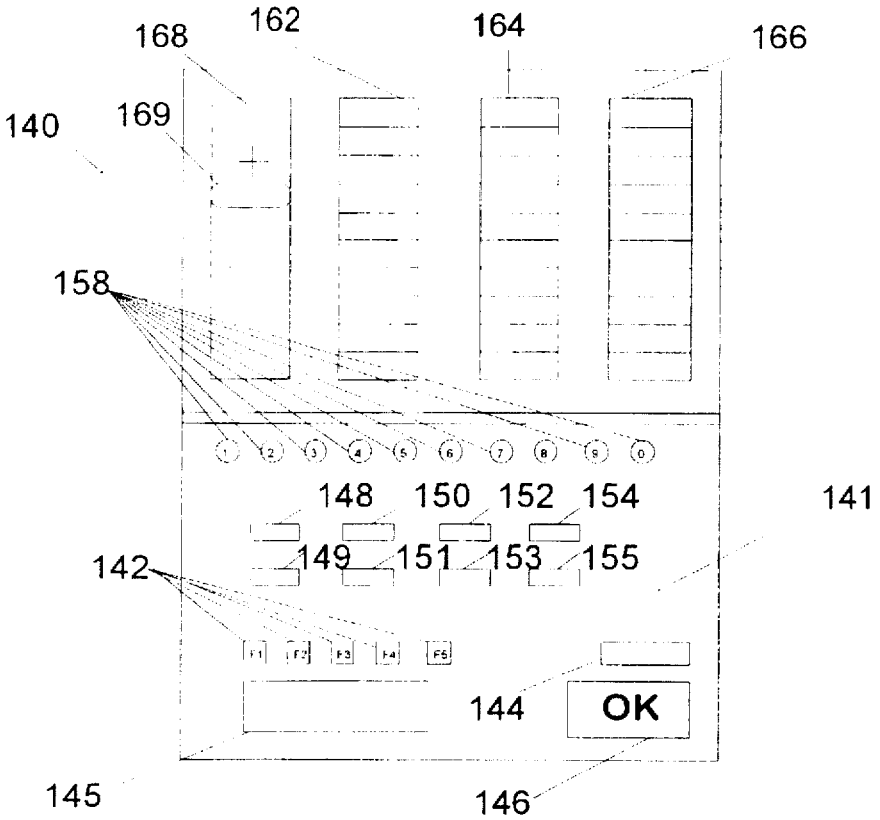
FIG. 8 is a top view of a seventh preferred embodiment of the device of the present invention similar to the embodiment of FIG. 3 and having a further time indicator.

A seventh preferred embodiment of the device according to the present invention is shown in FIG. 8. Similarly to FIG. 7, FIG. 8 shows a time scheduler 140, having a front surface 141, and including a confirmation key 146 for confirming the selection selected by the user. Surface 141 includes an alphanumeric display 145 for displaying the options and selections made and/or to be made by the user. Alphanumeric display 145 is preferably an LCD of a similar type to those found on organizers known in the art. Surface 141 also includes four visual displays for indicating to the user various statistical parameters.

A display 166, situated on surface 141, is part of a timing mechanism, and displays the overall time remaining in the test. Preferably, timing mechanism display 166 is in the form of a count-down timer. More preferably, timing mechanism display 166 can use either an LCD bar display or a plurality of LED's, such that when the user starts the test, all of the LED's are displayed and, as the time remaining decreases, the LED's go out indicating the time remaining. Preferably, timing mechanism display 166 indicates to the user when the time remaining is substantially all but exhausted. One of the ways timing mechanism display 166 can display a shortage of time is by flashing or changing color. Scheduler 140 optionally includes a speaker (not shown), similar to speaker 13 of FIG. 2, for emitting an audible sign indicating to the user when the time remaining is substantially all but exhausted.

Surface 141 also includes a display 164. Display 164 is part of a counter mechanism, and keeps track of the number of questions completed in the test. Counter mechanism display 164 can also be in the form of a count-down counter showing the number of questions remaining. Alternatively, counter mechanism display 164 displays the number of questions answered. Additionally and preferably, counter mechanism display 164 can use either an LCD bar display or a plurality of LED's, such that when the user starts the test, all of the LED's are displayed and, as the question remaining decrease, the LED's go out, such that the LED's displayed indicate the unanswered questions remaining in the test.

Here as well, surface 141 has a question timer display 162 for keeping track of the time remaining to answer the current question in the test. Similarly to displays 164 and 166, question time display 162 is in the form of a count-down timer showing the time remaining to answer the question. The time per question is calculated by dividing the overall time for the test by the overall number of questions in the test. Alternatively, question time display 162 displays the average time remaining for each question. The average time per question is calculated by dividing the time remaining in the test by the number of questions remaining in the test. Additionally and preferably, question time display 162 can use either an LCD bar display or a plurality of LED's, such that when the user starts the question all of the LED's are displayed and as the time remaining to answer the question decreases, the LED's go out, such that the LED's displayed indicate the time remaining to answer the question.

Surface 141 also includes a plurality of numeric keys 158 for inputting the overall number of questions in the test, the overall time for the test and other parameters deemed necessary by the user to be inputted prior to starting the test. Likewise, surface 141 also includes a plurality of keys designated 148–155, similar to keys 48–55 of FIG. 3 and keys 70–77 of FIG. 4, each of keys 148–155 having a specific use as explained hereinbelow. A time key 148 is provided for selecting the time available in the test and/or the time available for a specific section of the test having different time settings than other sections of the test. Depressing time key 148 and depressing numeric keys 158 inputs the time settings for that specific test or section in the test. A subsequent depressing of confirmation key 146 confirms the options selected. In case the user enters an erroneous entry, scheduler 140 also includes a delete key 149 facilitating the ready correction of such an erroneous entry by depressing delete key 149 as many times as needed for removing the error and reentering the correct information without having to input a new set of information in its entirety. Scheduler 140 optionally includes an amount key 150 for inputting the overall number of questions in the section or the test as well as an average key 151 for calculating the average time used to answer each question. The user may depress average key 151 either during or after the test or section has been completed, thereby receiving an output of the average time spent on answering each question. Preferably, the output is displayed on alphanumeric display 145 in a digital form. For the convenience of the user, an end key 152 is provided which, when depressed by the user, indicates the end of the string of entries, and also indicates the user has completed the test, notwithstanding the fact that there may still be questions remaining unanswered. When the user wishes to skip an option irrelevant to the test and/or section before him, he can elect to depress a next key 153 transferring the input to the next option while leaving the current option unchanged. As scheduler 140 has several modes of operation where, by way of example only, one or more of the four displays shown are of use to the user, a mode key 154 is provided for selecting which mode the user wishes to use.

Upon completing the entry of the parameters of the test, the user depresses a start button 144 starting the timer running and the user then proceeds to complete the test. Upon answering a question, the user depresses confirmation key 146 confirming a question has just been completed, thereby removing a question from the number of questions remaining on counter mechanism display 164 which keeps track of the number of questions completed in the test. Alternatively, the depression of confirmation key 146 confirming a question has just been completed, also manifests itself by altering the question time display 162, such that question time display 162 displays the average time remaining for each question. As explained hereinabove, the average time per question is calculated by dividing the remaining time in the test by the number of questions remaining in the test.

Upon completing the test, the user may want to store his performances for statistical and/or other purposes. Facilitating the ready storage of previous test information, the device preferably includes a memory key 155, the depression of memory key 155 stores all of the parameters and relevant information of the last test taken. More preferably, the device according to the present invention facilitates the storage of a plurality of previous tests by depressing memory key 155 as well as numeric keys 158, thereby storing the information for later retrieval. The user can also use average key 151 for calculating the averages of the information of any number of previous tests.

Like function keys 42 of FIG. 1, as well as to further satisfy the user's needs, five function keys 142 are provided on surface 141, which can be used for storing parameters of a specific type of section and/or test, such that the user has no need for reentering information immediately prior to or during the test and can do so in advance and recall the information by depressing function key 142 relevant to that section and/or test. According to certain embodiments exemplified herein, the user enters the overall time of available in the test and/or section with time key 148 for selecting the time available in the test and/or the time available for a specific section of the test having different time settings than other sections of the test as well as amount key 150 inputting the overall number of questions in the test. The subsequent depressing of function key 142 with memory key 155 stores all of the parameters and relevant information of the last test taken, thereby storing the parameters of the specific type of section and/or test, such that the user does not need to reenter information immediately prior to or during the test. When the user takes the test, he can readily recall the parameters by pressing the relevant function key 142 to that specific test or section.

Furthermore, surface 141 also includes a question speed indicator 168, like question speed indicator 128 of FIG. 7, for indicating whether the user is answering the questions at a slower or faster rate than the overall time for the test divided by the overall number of questions. Preferably, question speed indicator 168 can also indicate the progress of the user compared to the overall time in the test divided by the number of questions in the test and multiplied by the number of questions answered. Question speed indicator 168 also uses a bar 169 for showing whether the user is answering the questions at a slower or faster rate than the overall time for the test divided by the overall number of questions. The higher bar 169 is on question speed indicator 168 the faster the user is answering the questions in relation to the overall time for the test divided by the overall number of questions. The lower bar 169 is on question speed indicator 168 the slower the user is answering the questions in relation to the overall time for the test divided by the overall number of questions. Thus, the user can get an immediate feedback on his progress at a glance without having recourse to any calculations.

It will be appreciated that the above descriptions are intended only to serve as examples, and that many other embodiments are possible within the spirit and the scope of the present invention.

What is claimed is:

1. A time scheduler particularly useful for a user answering an overall number of questions in an overall time available in a test comprising:

(a) a timing mechanism for measuring an overall time elapsed;

(b) a counting mechanism for counting a number of units;

(c) a front surface;

(d) a first display situated on said surface, for displaying a parameter selected from the group consisting of said overall time elapsed and said number of units; and (e) a confirmation key on said surface, for changing said number of units, such that depressing said confirmation key changes said number of units by a single unit.

2. The device of claim 1, further comprising a second display on said surface, for displaying a time available for a single question.

3. The device of claim 1 further comprising a question speed indicator on said surface.

4. The device of claim 1, further comprising at least one selector key on said surface, for selecting options preferred by the user.

5. The device of claim 4, further comprising an alphanumeric display on said surface, for displaying said options.

6. The device of claim 5, wherein said alphanumeric display is selected from the group consisting of LCD's, LED displays, dot matrix displays, passive displays, active displays and CRT displays.

7. The device of claim 1, wherein said first display is selected from the group consisting of LCD's, LED displays, dot matrix displays, passive displays, active displays and CRT displays.

8. The device of claim 1, further comprising at least one function key on said surface, for storing and recalling the parameters used in a previous test.

9. The device of claim 1, wherein said front surface is distributed between two parts connected by a hinge.

10. The device of claim 1, further comprising a plurality of numeric keys on said surface, for entering numerical parameters.

11. The device of claim 1, whereupon said first display is a screen display.

12. The device of claim 11, wherein said screen display includes an indicator, for indicating when the time available in the test is substantially all but exhausted.

13. The device of claim 12, wherein said screen display is selected from the group consisting of LCD's, LED displays, dot matrix displays, passive displays, active displays and CRT displays.

14. The device of claim 1, further comprising a question time display on said surface, operated by said confirmation key, for timing a single question.

15. A time scheduler particularly useful for a user answering an overall number of questions in an overall time available in a test comprising:

(a) a timing mechanism for measuring an overall time elapsed;

(b) a counting mechanism for counting a number of units;

(c) a front surface;

(d) a first display situated on said surface, for displaying a parameter selected from the group consisting of said overall time elapsed and said number of units; and (e) a confirmation key on said surface, for changing the number of units, such that depressing said confirmation key changes said number of units by a single unit;

(f) a start button on said surface, for initiating said timing mechanism;

(g) a second display on said surface, for registering the time available for a single question;

(h) at least one selector key on said surface, for selecting options preferred by the user prior to confirming said selection with said confirmation key; and (i) an alphanumeric display on said surface, for displaying user-selectable options to be selected with said selector key.

16. The device of claim 15, further comprising:

(a) a question speed indicator on said surface;

(b) at least one function key on said surface, for storing parameters of a specific test type, such that the user can enter information for the test in advance and recall the information with said function key;

(c) a plurality of numeric keys on said surface, for inputting the overall number of questions in the test, the overall time for the test and other parameters deemed necessary by the user to be inputted prior to starting the test; and (d) at least one function key on said surface, for storing and recalling the parameters used in a previous test.

17. The device of claim 16, wherein said surface is connected to an indicator, for indicating when the time available in the test is substantially all but exhausted.

* * * * *